United States Patent [19]

Yamagishi

[11] Patent Number: 4,618,242

[45] Date of Patent: Oct. 21, 1986

[54] HEAT FIXING DEVICE FOR A COPYING MACHINE

[75] Inventor: Toshio Yamagishi, Nara, Japan

[73] Assignee: Sharp Kabushiki Kaisha, Osaka, Japan

[21] Appl. No.: 678,219

[22] Filed: Dec. 4, 1984

[30] Foreign Application Priority Data

Dec. 5, 1983 [JP] Japan ..... 58-230091
Dec. 9, 1983 [JP] Japan ..... 58-233262

[51] Int. Cl.[4] ..... G03G 15/20

[52] U.S. Cl. ..... 355/3 FU; 355/14 FU; 355/14 R; 219/216

[58] Field of Search ..... 355/3 FU, 14 FU, 14 E, 355/8, 14 CH, 3 CH, 14 R; 219/216

[56] References Cited

U.S. PATENT DOCUMENTS

| | | | |
|---|---|---|---|
| 4,259,565 | 3/1981 | Ogino et al. | 219/216 |
| 4,360,261 | 11/1982 | Kohyama | 355/14 E X |
| 4,373,802 | 2/1983 | Yuge et al. | 355/14 FU |
| 4,411,514 | 10/1983 | Komori et al. | 355/14 E X |
| 4,480,908 | 11/1984 | Anzai et al. | 355/14 FU X |
| 4,512,649 | 4/1985 | Derimiggio | 355/14 FU X |

*Primary Examiner*—A. C. Prescott

*Attorney, Agent, or Firm*—Birch, Stewart, Kolasch & Birch

[57] ABSTRACT

A heat fixing device comprises a fixing member for fixing particles onto a base material by heating, a detector for detecting environmental conditions surrounding and/or applied to the fixing member, and a controller responsive to the detector, for controlling the speed of the base material passing through the fixing means.

14 Claims, 8 Drawing Figures

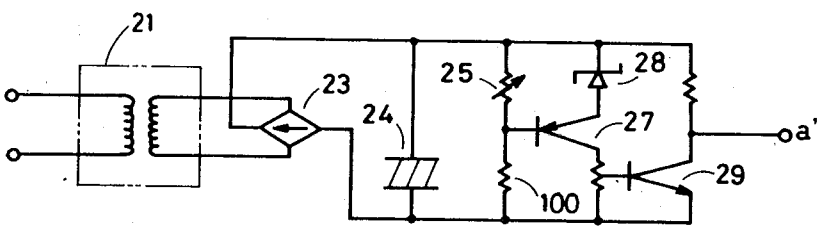
FIG.7
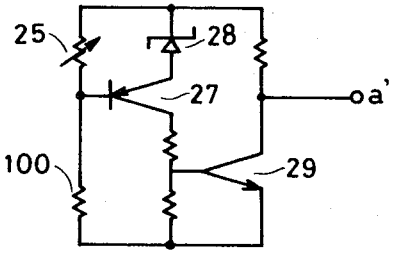
FIG.6
FIG.8
| TEMPERATURE (°C) / POWER VOLTAGE(%) | 5 | 15 | 25 |
|---|---|---|---|
| 110 | 30 | 30 | 30 |
| 105 | 30 | 30 | 30 |
| 100 | 30 | 30 | 30 |
| 95 | 25 | 30 | 30 |
| 90 | 25 | 25 | 30 |

HEAT FIXING DEVICE FOR A COPYING MACHINE

BACKGROUND OF THE INVENTION

The present invention relates a heat fixing device which fuses and fixes particles onto a base material such as a plain paper by heating and, more particularly, to heat fixing device for an electrophotographic copying machine which enables a high speed copying operation and a constant fixing property without increasing power consumption.

In recent years, electrophtographic copying machines employing a heat fixing device have been developed and such machines are widely used in many offices.

The copying operation of the copying machine has been rapidly increasing due to the requests for high speed copying. However, a problem occurs when the speed of the copy operation increases rapidly in that power consumption of the copying machine may increase and eventually exceed a standard power capacity, for example, a 15A power capacity standardized in Japan.

While the capacity of the heat fixing device must be increased in order to speed up the copying operation, the above problem may be present. To solve the above problem when such a copying machine performs the high speed copying operation, it is required that a power supply source be additionally provided with the heat fixing device for supplying a power which exceeds the standard power capacity.

OBJECT AND SUMMARY OF THE INVENTION

Accordingly, it is an object of the present invention to provide a heat fixing device for an electrophotographic copying machine which enables a high speed copying operation and a constant fixing property without increasing power consumption of the copying machine.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to an embodiment of the present invention, a heat fixing device comprises fixing means for fixing particles onto a base material by heating, detecting means for detecting environmental conditions surrounding the fixing means, and control means responsive to the detecting means, for controlling the number of the base material passing through the fixing means.

The detecting means is provided for detecting at least one variable such as variations in a power voltage, variations in the surrounding temperature around the fixing means, and the variations in the surrounding humidity around the fixing means.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 6 shows a circuit diagram of a temperature detector of a heat fixing device according to still another embodiment of the present invention;

FIG. 7 shows a circuit diagram of a temperature and voltage detector of a heat fixing device according to a further embodiment of the present invention; and FIG. 8 shows a table-representative of examples of a copying speed when the circuit of FIG. 7 is provided in FIG. 2 in place of the power voltage detector 201.

DETAILED DESCRIPTION OF THE INVENTION

Figure 1:
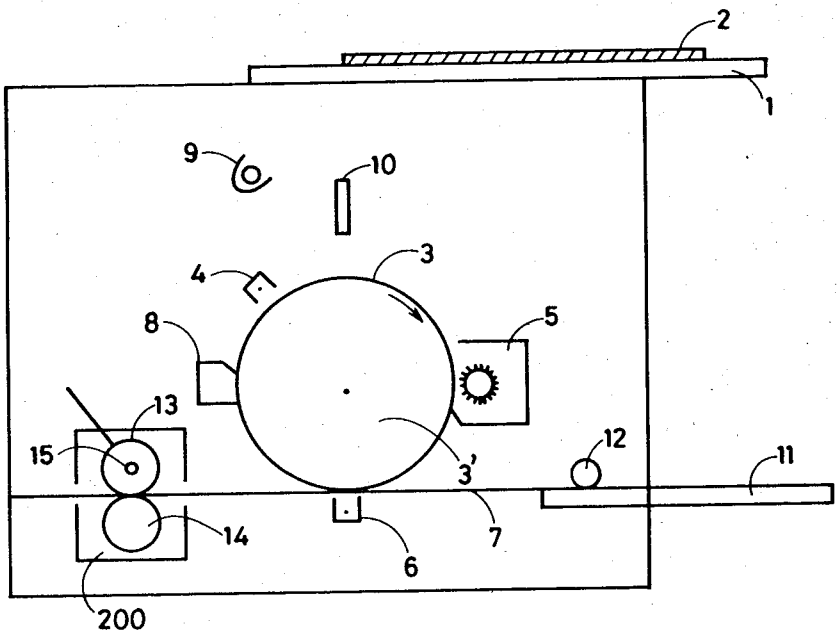
FIG. 1 shows a sectional view of an electrophotographic copying machine employing the heat fixing device according to an embodiment of the present invention.

FIG. 1 shows a sectional view of an electrophotographic copying machine including a heat fixing device according to an embodiment of the present invention.

A type of electrophotographic copying machine for reciprocating a document table carrying a copy document such as a manuscript or a book is shown. However, it should be noted that the present invention can be applied to another type of electrophotographic copying machine comprising part of an optical lens system moved along the document table.

The electrophotographic copying machine of FIG. 1 comprises a document table 1, a photoreceptor 3, a charger 4, a developing device 5, a transference charger 6, a cleaning device 8, a light exposing lamp 9, a plastic fiber lens 10, a copy paper cassette 11, a plurality of paper pick-up and feeding rollers 12, and a heat fixing device 200.

Referring to FIG. 1, the document table 1 for carrying a copy document 2 is reciprocated in a horizontal direction. The photoreceptor 3 is disposed around a rotational drum 3'. The charger 4 is provided for charging the photoreceptor 3. The light exposing lamp 9 is provided for exposing light toward the copy document 2 mounted on the document table 1 as the document table 1 is reciprocated in accordance with the rotation of the photoreceptor drum 3', so that the reflected light beams are incident onto the photoreceptor 3 through the plastic fiber lens 10 to form a latent image. The developing device 5 is provided for developing the latent image with toner particles to form a toner image. The cleaner 8 is provided for cleaning the photoreceptor 3 by removing the remaining toner particles from the photoreceptor 3 after the copying operation is carried out by rotating the drum 3. The transference charger 6 is provided for transferring the toner image onto a copy paper 7 picked up from a number of copy papers as stored within the cassette 11.

A plurality of paper pick-up and feeding rollers 12 are provided for picking up a single copy paper 7 from the copy papers in the cassette 11, and for feeding the picked-up copy paper into the transference charger 6. The heat fixing device 200 comprises a pair of fixing rollers 13 and 14 for pressing the toner image onto the copy paper to fix the toner image thereon. A heater 15 is provided in the heat-fixing roller 13 for heating the copy paper.

In the above copying machine, when a copy start button (not shown) is pressed, the document table 1 containing the copy document 2 is moved in a forward (left) direction from a home position of the document table 1 as shown in FIG. 1, and at the same time, the photoreceptor drum 3' is rotated in the clockwise direction. The image of the copy document 1 is exposed on the photoreceptor 3 by the light exposing lamp 9 through the plastic fiber lens 10, and the exposed image is converted into latent image by the developer 5. The latent image on the photoreceptor 3 is transferred onto a copy paper 7 by the transference charger 6, and thereafter, the copy paper 7 is applied to the fixing device 200. The copied paper 7 passes between the feeding roller 12 and the pair of fixing rollers 13, 14 and thereafter, the copy paper 7 is expelled from the copying machine. As soon as the forward movement of the document table 1 is completed and the switch (not shown) detects the completion of the forward movement the document table 1 is moved in the backward (right) direction to return to the home position.

A single copy operation is completed when the document plate 1 returns to the home position. When a single copy document is to be multi-copied, the above operations are repeated, while each copy paper is passed between the feeding roller 12 and the fixing rollers 13, 14 at a constant interval.

Figure 2:
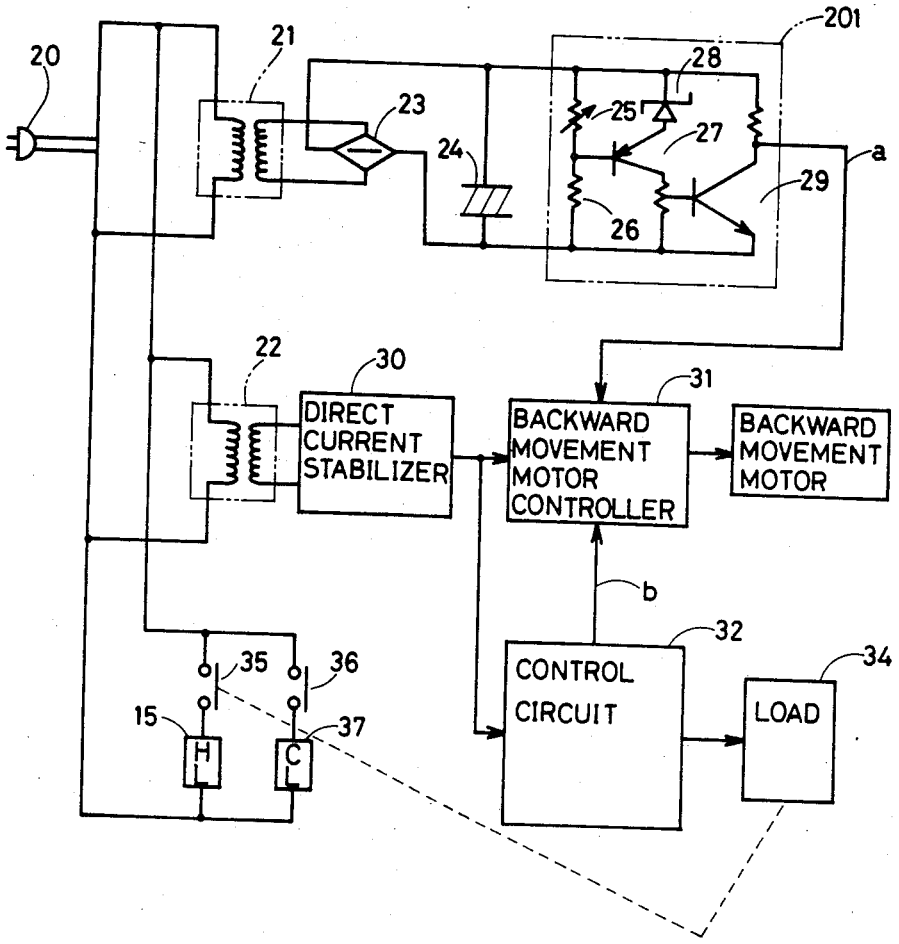
FIG. 2 shows a circuit diagram of a controller of the electrophotographic copying machine of FIG. 1.

FIG. 2 shows a circuit diagram of a controller of the electrophotographic copying machine of FIG. 1.

A power voltage applied from a power plug 20 is applied to the primary windings of a transformer 21 for a power voltage detector 201 and a transformer 22 for control circuits 31 and 32. The winding ratio between the primary and the secondary winding of the transformer 21 is selected so that a voltage across the secondary winding of the transformer 21 is set at about 8 Volts in the standard condition. The output of about 8 volts of the transformer 21 is applied to a full wave rectifier 23. A condenser 24 smoothes a full wave rectifying voltage from the full wave rectifier 23 to provide a direct current voltage of about 10 Volts from the secondary winding voltage of about 8 Volts. The smoothed voltage is divided by a variable resistance 25 and a resistance 26. The divided voltage is applied to the base of a transistor 27. A Zener diode 28 is connected to an emitter of the transistor 27 for providing a reference voltage of about 5 Volts. The transistor 27 turns on and off based on the difference of an addition, between the Zener voltage of about 5 Volts and the base-emitter voltage of the transistor 27, with a voltage across the variable resistance 25. A transistor 29 receives an output of the transistor 27, and turns on and off in synchronization with the ON/OFF of the transistor 27 to provide a power voltage detecting signal a.

As described above, the power voltage detector 201 for detecting the variations in the power voltage comprises the variable resistance 25, the resistance 26, the transistors 27 and 29, and the Zener diode 28.

The output of the secondary winding of the transformer 22 is stabilized by a direct current stabilizer 30, and the stabilized voltage from the stabilizer 30 is applied to a backward movement motor controller 31 and a control circuit 32. The backward movement motor controller 31 receives the output (the power voltage detecting signal a) of the transistor 29 in the power voltage detector 201 to control the rotating speed of the backward movement motor 33.

The control circuit 32 is provided for controlling both the backward movement motor controller 31 and a load 34 including a solenoid, relayes, a clutch, and a motor or the like. For example, the control circuit 32 outputs a backward movement enabling signal b, which is applied to the backward movement motor controller 31.

The power voltage from the power plug 20 is, further, applied to a heater 15 for the heat fixing device 200 through a relay contact 35, and to the light exposing lamp 37 through a relay contact 36. The relay contacts 35 and 36 are included in the load 34, and are turned on and off according to the output of the control circuit 32.

In the embodiment of the present invention, the heater 15 of the heat fixing device 200 uses a standard power of 900 W. In general, in the high speed copying machine having a copying speed of about 30 copied papers/minute, the electric power of about 800 W must be continuously applied to the heater 15 of the heat fixing device 200 to sufficiently fix toner particles onto the copy paper 7. Accordingly, if the heater 15 is used with an electric power of about 900 W, the heat fixing device 200 is operated having an excess electric power of about 100 unconsumed watts.

The variable resistance 25 in the voltage detector 201 will be described next.

If the heater 15 is used of the electric power of about 900 W, the output of the heater 15 becomes about 800 W when the applied power is a voltage of about 95% of the standard power voltage of about 900 W. Therefore, the heat fixing device 200 can sufficiently fix the toner particles by applying the voltage at more than about 95% of the standard power voltage whereby the copying operation speed is about 30 copied papers/minute. On the other hand, when the power voltage is a voltage of about 90% of the standard power voltage in accordance with the variations in the power voltage, the output of the heater 15 is about 700 W. Therefore, in this case, the copying operation speed should be decreased as long as the surface temperature of the heat-fixing roller 13 in the heat fixing device 200 is not decreased in a continuous copying operation. As an experimental result, the copying operation speed should be set at about 25 copied papers/minute so that the heat fixing device 200 can sufficiently fix the tonner particles onto the copy paper 7 by receiving the voltage of about 90% of the standard power voltage. Accordingly, when the power voltage is within a range between about 90% to 95% of the standard power voltage, the copying operation speed should be set at about 25 copied papers/minute.

Thus, in the case where the heater 15 of the standard power about 900 W is used in the heat fixing device 200, the copying operation speed should be set at about 30 copied papers/minute as long as the power voltage is more than 95% of the standard voltage, and should be set at about 25 copied papers/minute long as the power voltage is less than or equal to 95% of the standard voltage. The fixing property thereby becomes constant regardless of the variations in the applied voltage. Therefore, the resistance of the variable resistance 25 in the power voltage detector 201 is selected to detect whether the 95% voltage as the power voltage is provided or an amount more or less than this amount.

The voltage across the condenser 24 is about 10 Volts as described above when the standard power voltage is applied. If the power voltage is the 95% of the total voltage, voltage across the condenser 24 becomes about 9.5 Volts. On the other hand, because the Zener voltage of the Zener diode 28 is set at about 5 Volts, and if a voltage across the variable resistance 25 is set at about 5.65 Volts of an addition between the Zener voltage of about 5Volts and the base-emitter voltage of about 0.65 Volts of the transistor 27, than when the voltage across the condenser 24 is about 9.5 Volts, the transistor 27 is continuously turned off when the applied voltage is less than or equal to the 95% voltage and is continuously turned on when the applied voltage is more than the 95% voltage. Accordingly, the power voltage detector 201 outputs the power voltage detecting signal a of "H" (High) when the power voltage is less than or equal to the 95% voltage, and outputs the power voltage detecting signal a of "L" (Low) when the applied voltage is more than the 95% voltage.

When the operating condition of the variable resistance 25 is selected as described above, the backward movement motor controller 31 can control the rotating speed of the backward movement motor 33 with a boundary of the 95% voltage. The backward movement controller 31 can decrease the rotating speed of the backward movement motor 33 toward the copy speed of about 25 copied papers/minute when the power voltage detecting signal a of "H" is applied to the backward movement controller 31.

The backward movement motor controller 31 can increase the rotating speed of the backward movement motor 33 to select the copying speed of about 30 copied papers/minute when the power voltage detecting signal a of "L" is applied to the backward movement motor 31.

As described above, the voltage detector 201 functions to detect the variations in the power voltage applied to the heater 15 of the heat fixing device 200, i.e., the variations in the temperature on the surface of the heat-fixing roller 13.

Therefore, in the case where the power voltage to the heater 15 is more than the 95% voltage, the copying machine can perform the high speed copying operation of about 30 copied papers/minute.

In this case, because the excess power consumed by the heater 15 is not so great, the power consumption of the heat fixing device cannot be increased so as to provide a high-speed copying machine.

The backward movement motor controller 31 will be described with reference to FIG. 3.

Figure 3:
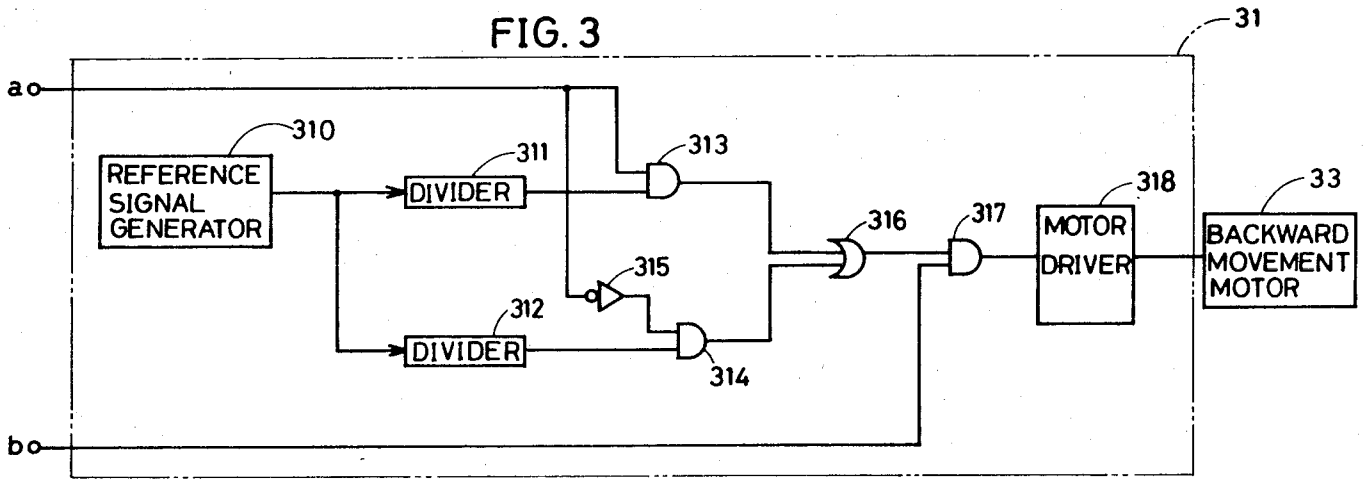
FIG. 3 shows a circuit diagram of a backward movement motor controller 31 in the controller of FIG. 2.

Referring to FIG. 3, a reference signal generator 310 generates constant reference pulses, and the output of the reference signal generator 310 is applied to dividers 311 and 312. The divider 312 has a dividing ratio less than that of the divider 311.

An AND gate 313 serves to provide a logical "AND" between the power voltage detecting signal a and the output signal of the divider 311. An inverter 315 inverts the power voltage detecting signal a. An AND gate 314 serves to provide a logical "AND" between the inverted power voltage detecting signals a and the output signal of the divider 312.

An OR gate 316 serves to provide a logical "OR" between the outputs of the AND gates 313 and 314. An AND gate 317 serves to provide a logical "AND" between the logical sum output of the OR gate 316 and the backward movement enabling signal b from the controller 32, and the output of the AND gate 317 is applied to a back movement motor driver 318. The output of the back movement motor driver 318 is applied to the backward movement motor 33.

As described above, when the power voltage detecting signal a is the signal "L", the output of the divider 312 is introduced to the motor driver 318. When the power voltage detecting signal a is the signal "H", the output of the divider 311 is introduced to the motor driver 318.

Because the dividing ratio of the divider 311 is greater than that of the divider 312, a frequency of a dividing pulse introduced to the motor driver 318 in the case of the power voltage detecting signal a of "H" is less than that of a dividing pulse in the case of the power voltage detecting signal a of "L".

The rotating speed of the backward movement motor 33, when the power voltage detecting signal a is the signal "L", is greater than that of the backward movement motor 33 when the power voltage detecting signal a is the signal "H".

As a result, the backward movement speed of the document table 1 may be increased when the power voltage is more than the 95% voltage. On the contrary, the backward movement speed of the document table 1 may be relatively decreased when the power voltage is less than or equal to the 95% voltage.

If the dividing ratios of the dividers 311 and 312 are suitably selected, respectively, the document table 1 can be moved in the backward direction to be copied at the copying speed of about 30 copied papers/minute when the power voltage is more than the 95% voltage, and can be moved in the backward direction to be copied at the copying speed of about 25 copied papers/minute when the power voltage is less than or equal to the 95% voltage.

Though the rotating speed of the backward movement motor 33 in the above embodiment is controlled based on the 95% voltage, the rotating speed of the backward movement motor 33 may be controlled based on voltages of 94% and 97% of the standard power voltage so as to move the document table 1 by three-step backward movement speeds. Such a copying machine will be described with reference to FIGS. 4 and 5.

Figure 4:
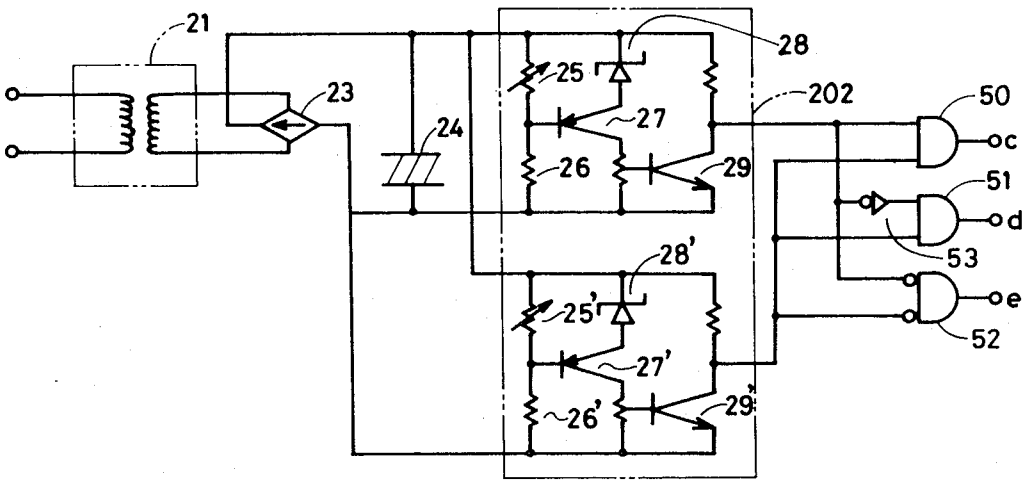
FIG. 4 shows a circuit diagram of the voltage detector 202 of a heat fixing device according to another embodiment of the present invention.
Figure 5:
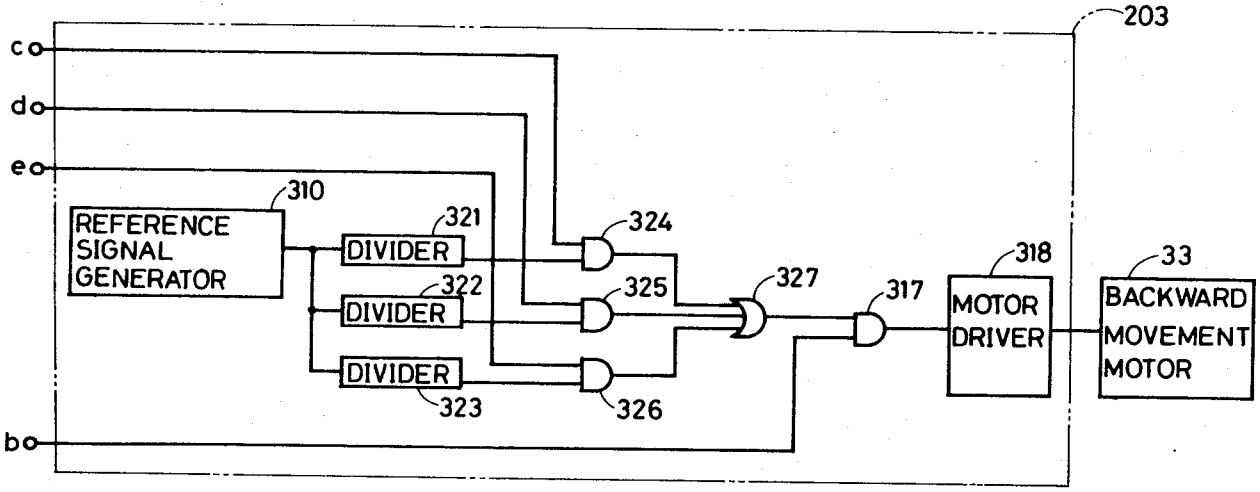
FIG. 5 shows a circuit diagram of a backward movement motor controller 203 in a heat fixing device according to another embodiment of the present invention.

FIG. 4 shows a circuit diagram of a power voltage detector 202 of a heat fixing device according to another embodiment of the present invention. FIG. 5 shows a circuit diagram of a backward movement motor controller 203 of a heat fixing device according to another embodiment of the present invention.

Like elements corresponding to the parts of FIGS. 4 and 5 are denoted by like reference characters FIGS. 2 and 3.

The feature of the another embodiment of the present invention is that a pair of voltage detectors are provided in parallel.

The first voltage detector comprises a variable resistance 25, a resistance 26, transistors 27 and 29, and a Zener diode 28. The second voltage detector comprises a variable resistance 25', a resistance 26', transistors 27' and 29', and a Zener diode 28'.

The resistance of the variable resistance 25 is selected to detect whether a voltage of 94% of the standard power voltage is provided, more or less. The resistance of the variable resistance 25' is selected to detect whether a voltage of 97% of the standard power voltage is provided, more or less. The outputs of the transistors 29 and 29' are applied to AND gates 50, 51, and a AND gate 52 with invertors at the input portions, respectively, but the AND gate 51 receives the output of the transistor 29' through an inverter 53.

Three power voltage detecting signals c, d and e are outputted from the AND gates 50, 51, and the AND gate 52 with invertors at the input portions, respectively, according to the variations in the power voltage applied to the heat fixing device 200.

The power voltage detecting signals c, d, and e are applied to AND gates 324, 325, and 326, respectively, and at the same time, the outputs of dividers 321, 322, and 323 are applied to the AND gates 324, 325, and 326, respectively. One of the dividers 321, 322, and 323 is selected according to the power voltage signals c, d, and e, and the dividing pulse of the selected divider is applied to the backward movement motor controller 318.

The dividing ratio of the divider 321 is greater than that of each of the dividers 322 and 323, and the dividing ratio of the divider 322 is greater than that of the divider 322.

The transistor 29 outputs the power voltage detecting signals a' of "H" when the power voltage is less than or equal to 94% of the voltage and outputs the power voltage detecting signals a' of "H" when the power voltage is more than 94% of the voltage. The transistor 29' outputs the power voltage detecting signal a' of "L" when the power voltage is less than 97% of the standard power voltage and outputs the power detecting signal a' of "L" when the power voltage is greater than or equal to 97% of the standard power voltage.

When the outputs of the transistors 29 and 29' are "H", the power voltage detecting signal c is "L". When the output of the transistor 29 is "H" and the output of the transistor 29' is "H", the power detecting signal d is "H". When the outputs of the transistors are the signals "L", the power voltage detecting signal e is "H". Accordingly, the divider 321 is selected from the three dividers when the power voltage is less than or equal to 94% of the standard power voltage. The divider 322 is selected from the three dividers when the power voltage is within a range from 94% to 97% of the standard power voltage. The divider 323 is selected from the three dividers when the power voltage is greater than or equal to 97% of the standard power voltage.

The outputs of the AND gates 324, 325, and 326 are applied to the OR gate 316. The output of the OR gate 316 and the backward movement enabling signal b from the control circuit 32 and applied to the AND gate 317. The output of the AND gate 317 is applied to the motor driver 318.

Accordingly, the backward movement motor 33 is rotated at a first speed when the power voltage is less than or equal to 94% of the standard power voltage. If the power voltage is within the range of 94% to 97% of the standard power voltage, the backward movement motor 33 is rotated at a second speed which is faster than the first speed. If the power voltage is greater than 97% of the standard power voltage, the backward movement motor 33 is rotated at a third speed faster than the second speed. The document table 1 can be moved in the backward direction to return to the home position according to the rotating speed of the backward movement motor 33.

As the variations in the surface temperature of the heat-fixing roller 13 are mainly due to the decrease in the power voltage applied to the heat fixing device 200, the backward movement speed of the document table 1 can be controlled based on the detection in the decrease of the power voltage as described above.

Further, the variations in the surface temperature of the heat-fixing roller 13 may be due to the variations in the surrounding temperature and the surrounding humidity around the heat-fixing roller 13, etc. in addition to the variations in the power voltage.

For example, when the surrounding temperature around the heat-fixing roller 13 is low, the temperature of the copy paper 7 is also low, so that the copy paper 7 passing between the feeding roller 11 and the fixing rollors 13, 14 requires a larger amount of heat from the fixing roller 13 during the fixing operation. Therefore, to maintain the temperature on the surface of the heat-fixing roller, the power voltage should be required to be greater than the power voltage consumed with a high surrounding temperature.

If the humidity surrounding the heat-fixing roller 13 is high, the humidity of the copy paper is increased, so that the power voltage should be required to be greater than the power voltage consumed at a low humidity due to the fact that the wet copy paper will absorb more heat.

FIG. 6 shows a circuit diagram of a temperature detector of a heat fixing device according to still another embodiment of the present invention.

The embodiment shown in FIG. 6 of the present invention controls the backward movement speed of the backward movement motor 33 according to variations in temperature surrounding the heat-fixing roller 13 itself.

The feature of the still another embodiment of the present invention is that a thermistor 100 FIGS. 6, 7 is provided in place of the resistance 26 of FIG. 2.

The resistance of the thermistor 100 proportionally becomes low as the temperature increases.

The resistance of the variable resistance 25 is selected so that the transistor 29 turns on at a predetermined temperature. A temperature detecting signal a' is "L" (Low) when the surrounding temperature is greater than the predetermined temperature, and the temperature detecting signal a' is "H" (High) when the surrounding temperature is less than or equal to the predetermined temperature.

When the temperature detecting signal a' from the transistor 29 is applied to the backward movement motor controller 31, the rotating speed of the motor 33 can be changed by detecting whether the surrounding temperature is greater than the predetermined temperature. Therefore, the copying operation speed can change based on the variations in temperature surrounding the heat-fixing roller 13.

As shown in FIG. 4, two or more temperature detectors may be provided in parallel in a multi-stage manner so that the copying speed of the copying machine is controlled by steping some speed ranges.

If a humidity detecting sensor is provided in FIG. 6 in place of the thermistor 100, the copying speed of the copying machine can be controlled according to variations in humidity surrounding the heat-fixing roller 13.

As shown in FIG. 7, if the circuit of FIG. 6 is connected to a power circuit of FIG. 2, the variations both in the power voltage and temperature surrounding the heat-fixing roller 13 can be detected at the same time, so that the copying speed can change according to both variations in the power voltage and the temperature.

FIG. 8 shows a table with representative examples of copying speed when the circuit of FIG. 7 is provided in FIG. 2 in place of the power voltage detector 201. In FIG. 8, a unit is copied papers/minute, and a "POWER VOLTAGE" is denoted as ((applied power voltage)/(standard power voltage))×100 (%). For example, when the temperature is 15 degrees C. and the "POWER VOLTAGE" is 95%, the copying speed is 30 copied papers/minute.

In the above embodiments, the number of copy papers passing between the feeding roller 11 and the fixing rollers 13, 14 within a constant (unit) interval, i.e., the copy speed of the copying machine, is controlled by changing the backward movement speed of the document table. In an optical system movement type electrophotographic copying machine, the backward movement speed of the optical system moved along the document table, for scanning the copy document, may be controlled so as to change the number of the copied papers passing between the fixing rollers or the copy speed.

In place of the backward movement speed of the document table or the optical system, the forward movement speed or both the forward and backward movement speeds may be changed. A turning interval changing from the forward movement to the backward movement of the document table or the optical system, or the vice versa, may be controlled to change the copying speed.

Another method for controlling the number of the copy papers passing between the feeding roller and fixing rollers within the unit interval is to control a real transfer speed of the copy paper. In a case where the surface temperature of the heat-fixing roller becomes low in accordance with the decrease of the power voltage, the transfer speed of the copy paper may be low so that the number of copy papers passing between the feeding roller and the fixing rollers within the unit interval is decreased. Therefore, the fixing device can sufficiently fix the toner particles onto the copy paper with a constant fixing property.

Still another method for changing the number of the copy papers passing between the feeding roller and the fixing rollers within the unit interval is that the rotating speed of the heat-fixing roller may be changed.

Though the power voltage detector, the temperature detector, and the humidity detector etc. are used for detecting the environments relating to variations in the surface temperature of the heat-fixing roller, the surface temperature of the heat-fixing roller may directly detected to control the copying speed. For example, after the surface temperature on the heat-fixing roller is directly measured, the copy speed may be changed to set the surface temperature at the predetermined constant temperature. Thus, the fixing device can sufficiently fix the toner particles onto the copy paper even when the power voltage is varied. The fixing property is therefore constant regardless of the variations in the applied power voltage.

Still another method for detecting the variations in the surface temperature of the heat-fixing roller is that a continuous power supply time to the heater in the fixing roller may be detected. In this case, the power is continuously applied to the fixing device if the surface temperature of the heat-fixing roller is decreased. Therefore, when the continuous power supply time is within a predetermined interval, meaning that the temperature of the heat-fixing roller maintained, the copy speed can be increased. On the contary, when the continuous power supply time is over the predetermined time interval, meaning that the temperature of the heat-fixing roller is not constant, the copying speed is decreased.

A further method for controlling the copy speed is by controlling the number of reciprocating movements of the document table or the optical system within the unit interval such that an interval while the copying machine performs a single reciprocating movement may be controlled.

In the present invention, when the power voltage applied to the fixing device is not balanced with heat emitted from the heat-fixing roller in accordance with the decrease of the power voltage, the temperature or the humidity, the number of the base material such as the copy papers passing through the fixing device is decreased to keep the appropriate balance between the power voltage and the emitted heat.

According to the present invention, the copying machine can perform a high speed copying operation while maintaining a constant toner-fixing property in its heat-fixing device. Some external disturbances to the fixing device which will possibly damage the toner-fixing property can be preliminarily detected so that the toner-fixing property can be optimized by varying the number of the base material passing through the fixing device.

The number of the detecting means for detecting the disturbances to the fixing device, such as the power voltage detector, the temperature detector, and the humidty detector sensor, etc. can be selected freely.

The present invention can be applied to any machine other than the copying machine.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A heat fixing device comprising:

fixing means for fixing particles onto a base material by heating;

detecting means for detecting environmental conditions surrounding and/or applied to the fixing means; and control means responsive to the detecting means, for controlling the speed or number of the base material passing through the fixing means.

2. The device of claim 1, wherein the detecting means detects the variations in the power voltage applied to the device.

3. The device of claim 1, wherein the detecting means detects the variations in the temperature surrounding the fixing means.

4. The device of claim 1, wherein the detecting means detects the variations in the humidity surrounding the fixing means.

5. The device of claim 1, wherein the detecting means is provided for detecting at least one variable selected from the variations in the voltage, the variations in the temperature surrounding the fixing means, and the variations in the humidity surrounding the fixing means.

6. The device of claim 1, wherein the detecting means detects the surface temperature on the fixing means.

7. The device of claim 1, wherein the detecting means detects time or supplying power while the power is applied to the fixing means.

8. The device of claim 1, wherein the fixing device is disposed in a copying machine.

9. The device of claim 8, wherein the copying machine comprises scanning means for scanning an image on a document, transfer means responsive to the scanning means for transferring toner particles onto the base material, and second control means are responsive to the detecting means for controlling the reciprocating speed of the scanning means.

10. The device of claim 9, wherein the speed of the scanning means is controlled by changing the number of reciprocating movements of the scanning means.

11. The device of claim 9, wherein the speed of the scanning means is controlled by changing the total time of a single cycle of the reciprocating movement of the scanning means.

12. The device of claim 1, wherein the number of base material is controlled by providing means for changing the forward and/or backward movement speed of a document table.

13. The device of claim 1, wherein the number of base material is controlled by providing means for changing the forward and/or backward movement speed of an optical system moved along a document table for scanning the copy document.

14. The device of claim 1, wherein the fixing means include heat fixing rollers and the number of base material is controlled by providing means for changing the rotating speed of the heat fixing rollers.

* * * * *